US007263928B1

(12) United States Patent
Holden et al.

(10) Patent No.: US 7,263,928 B1
(45) Date of Patent: Sep. 4, 2007

(54) AUTOMATIC CHUTE OPENING SYSTEM FOR STRAPPING MACHINE

(75) Inventors: David W. Holden, Joliet, IL (US); Allan J. Bobren, Streamwood, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 11/554,480

(22) Filed: Oct. 30, 2006

(51) Int. Cl.
*B65B 13/04* (2006.01)
*B65B 13/18* (2006.01)

(52) U.S. Cl. ..... 100/26; 100/29; 53/589

(58) Field of Classification Search ..... 100/25, 100/26, 29, 7; 53/589
See application file for complete search history.

(56) References Cited

U.S. PATENT DOCUMENTS 3,330,205 A * 7/1967 Smith ..... 100/4
6,962,109 B2 * 11/2005 Bobren et al. ..... 100/26

* cited by examiner

*Primary Examiner*—Jimmy Nguyen
(74) *Attorney, Agent, or Firm*—Mark W. Croll; Donald J. Breh; Levenfeld Pearlstein, LLC

(57) ABSTRACT

An automatic strap chute opening system for use in a strapping machine of the type having an openable, pivotable work surface for supporting a load to be strapped, and a strap chute defining a strap path through which the strapping material is passed. The chute is disposed in part below the surface and is openable to release the strapping material from the chute during the strapping operation. The chute opening system includes a torsional element operably connected to the strap chute for opening and closing the chute and an actuator operably connected to the torsional element. The coordinated movement of the actuator and torsional element corresponds with the opening or closing of the work surface.

20 Claims, 4 Drawing Sheets

AUTOMATIC CHUTE OPENING SYSTEM FOR STRAPPING MACHINE

BACKGROUND OF THE INVENTION

The present invention is directed to a strapping machine chute opening system. More particularly, the present invention is directed to a strapping machine having a chute opening system that automatically opens the strap chute upon opening the work surface or table top of the machine.

Strapping machines are well known in the art for securing straps around loads. One type of known strapper is a stationary unit that includes a strapping head or weld head and drive mechanism mounted within a frame. A chute is mounted to the frame, through which the strapping material is fed. In a typical arrangement, a table-top or work surface is likewise mounted to the frame.

In a typical stationary strapper, the chute is mounted from about the work surface, and the strapping head is mounted below the work surface. Strap is fed (by a feed system) from a source or dispenser through the strapping head and chute and back to the strapping head, to pull the strap from the chute to around the load and to tension the strap around the load.

In the event a strap error occurs, the faulted strap is ejected from the strapping machine by the feed system. Typically, this process is carried out automatically to reduce operation time and attention. However, there are times that an operator must access the area below the work surface and times at which the operator must open the bottom leg of the chute (adjacent to the strapping head) in order to, for example, clear strap from the chute.

One known arrangement that provides both a work surface support function and a chute opening function uses a long, cantilevered arm with a spring that pivots upwardly to assist the opening function. The system is configured such that the spring is substantially tensioned when the work surface is in the down or operating position.

One drawback to this arrangement is that a "lighter" work surface is more likely to pivot slightly open which in turn isolates power to the strapper (through a keyed interlock). Moreover, if the work surface is replaced, it must be replaced with a surface of similar weight and configuration. In addition, because the spring is at tension when the work surface is open, the spring might not be able to provide sufficient force to then open the chute.

Accordingly, there is a need for a strapping machine having an automatic chute opening system. Desirably, such a system uses a cam surface to leverage the opening of the work surface for opening the chute.

BRIEF SUMMARY OF THE INVENTION

A strap chute opening system is for use in a strapping machine of the type for feeding a strapping material around a load, positioning, tensioning and sealing the strapping material around the load. A strapping machine includes a frame, a work surface for supporting the load to be strapped, in which the work surface is movable relative to the frame between a closed position and an open position, and a strap chute that defines a strap path through which the strapping material is passed and a portion of which is disposed below the surface The strap chute is openable to release the strapping material from the chute during the strapping operation. A strapping head is disposed below the work surface and a portion of the strapping head is interposed in the strap chute.

The chute opening system is automatic and uses a cam surface to leverage the opening of the work surface to open the chute. The opening system includes a torsional element operably connected to the strap chute to move the strap chute between the open and closed positions and an actuator operably connected to the torsional element.

The actuator includes a work surface engaging element that engages the work surface and is movable with the work surface between the open and closed positions. The work surface engaging element has a cam surface on a lower portion thereof.

The actuator includes a pivoting arm having a first end having a cam engaging element, preferably a roller, and a second end operably engageable with the torsional element. When the work surface is in the closed position, the work surface engaging element is engaged with the work surface and urges the cam surface into engagement with the cam engaging element to pivot the arm. This releases the torsional element and urges the strap chute closed. When the work surface is in the open position, the work surface is moved off of the work surface engaging element and the cam surface is moved out of engagement with the cam engaging element. This moves the second end into engagement with the torsional element (to apply a torque to the torsional element) to open the strap chute.

In a present embodiment, a biasing element, such as a spring, biases the pivoting arm into engagement with the torsional element. The torsional element can include a lever mounted thereto that is engaged by the pivoting arm.

A preferred actuator includes a guide defining a track for movement of the work surface engaging element. The guide restricts movement of the work surface engaging element in a reciprocating manner. In this arrangement, the cam engaging element lies in the track and engagement of the cam surface with the cam engaging element moves the cam engaging element out of the track. A preferred guide is formed by rollers to permit the work surface engaging element to move (reciprocate) freely through the actuator.

In a present embodiment, the work surface engaging element includes an inverted J-shaped channel formed and the actuator includes a pin extending therefrom that engages the J channel. The J channel has an elongated leg and a short leg and the pin resides in the elongated leg as the work surface engaging element moves with the work surface between the open and closed positions. The pin resides in the short leg when the work surface is in the open position and strap chute is in the closed position.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

While the present invention is susceptible of embodiment in various forms, there is shown in the figures and will hereinafter be described a presently preferred embodiment with the understanding that the present disclosure is to be considered an exemplification of the invention and is not intended to limit the invention to the specific embodiment illustrated.

It should be further understood that the title of this section of the specification, namely, "Detailed Description Of The Invention", relates to a requirement of the United States Patent Office, and does not imply, nor should be inferred to limit the subject matter disclosed herein.

Figure 1:
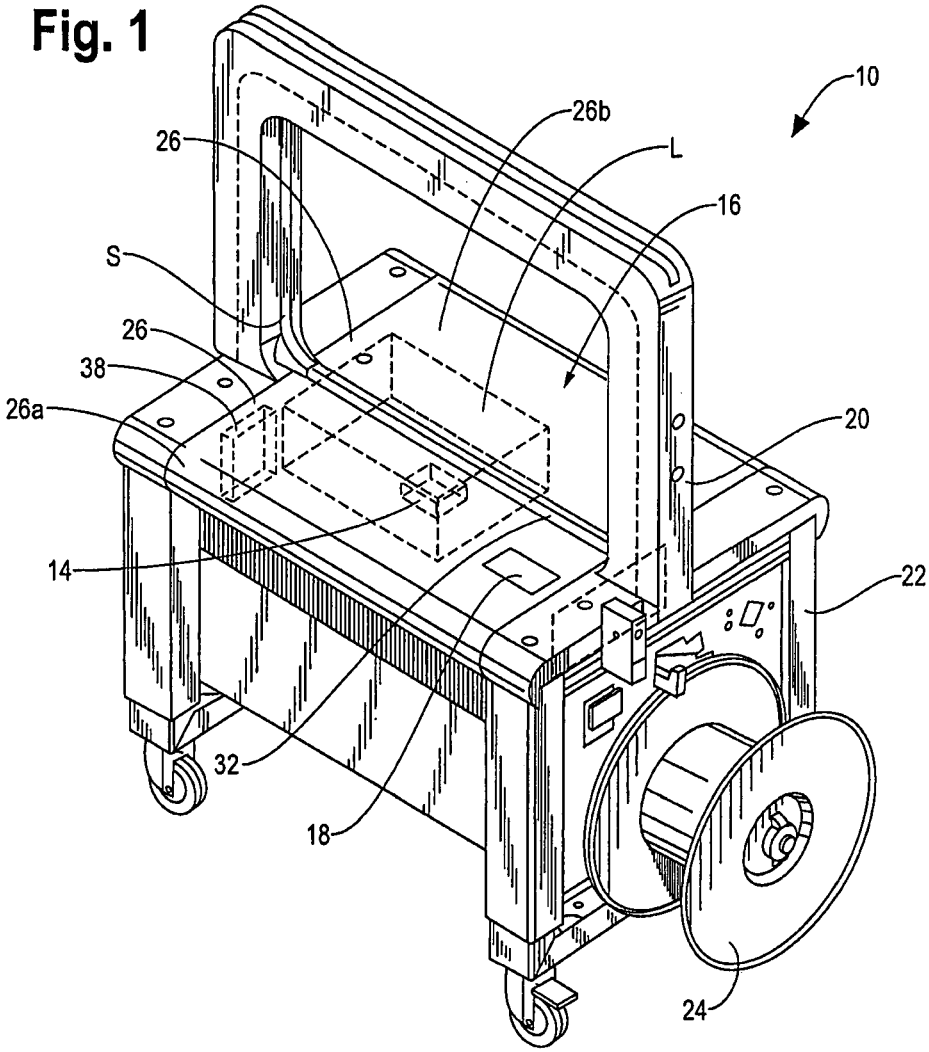
FIG. 1 is a perspective view of an exemplary strapping machine having an automatic chute opening system embodying the principles of the present invention.

Referring to the figures and in particular to FIG. 1 there is shown a strapping machine 10 having an automatic chute opening system 12 in accordance with the principles of the present invention. The illustrated machine 10 is a bottom-seal strapper, meaning that the strapping head 14 (or sealing head), which forms the seal of the strap S onto itself is at the bottom of the area 16 into which the load L is positioned for strapping. The strapper 10 includes, generally, the strapping or sealing head 14, a feed system 18 and a strap chute 20. A frame 22 supports the various elements of the machine 10. A dispenser 24 supplies the strap material S to the strapper 10 via the feed system 18 to a feed head (not shown).

The strapper 10 includes a table top or work surface 26 on which the load L is positioned during the strapping operation. The top surface 26 can be formed as a pair of flat plate-like elements (as illustrated by 26*a* and 26*b*), or they can be driven or undriven rollers or conveyors. All such types of top surfaces are contemplated to be within the scope and spirit of the present invention. While the top 26 types can vary they can all be removed, generally by pivoting the top surface upwardly and outwardly from the center, generally pivoting about pivot pins 30.

In a typical configuration, the strap S is fed into the strapper 10 by the feed system 18 and is directed through sealing head 14 and into the bottom leg 32 of the strap chute 20, around the chute 20 and back to the sealing head 14. Once the strap S reenters the sealing head 14, a free end of the strap S is held or secured, the feed end is tensioned around the load L, and the overlapping strap courses are sealed to one another as the feed end is severed from the supply. The load L is then discharged from the machine 10.

At times during the strapping cycle, strap jams may occur, or other types of strap misfeeds may occur. Generally, these jams or misfeeds are cleared automatically by an automatic ejection system and the free end of the strap is refeed into the machine also by automatic means (neither of the automatic ejection system or the automatic refeed system are shown). At times, however, the automatic ejection and/or refeed systems may not be able to fully clear the machine. At other times, there may be need to access the strap chute 20 (and the sealing head 14) for maintenance, inspection or repair.

In order to properly access the strap chute 20 the top surface 26 is removed from the machine 10 or moved away from the chute 20 as by pivoting the top 26 upwardly and outwardly. This provides ready access to strap chute 20 area.

Figure 2:
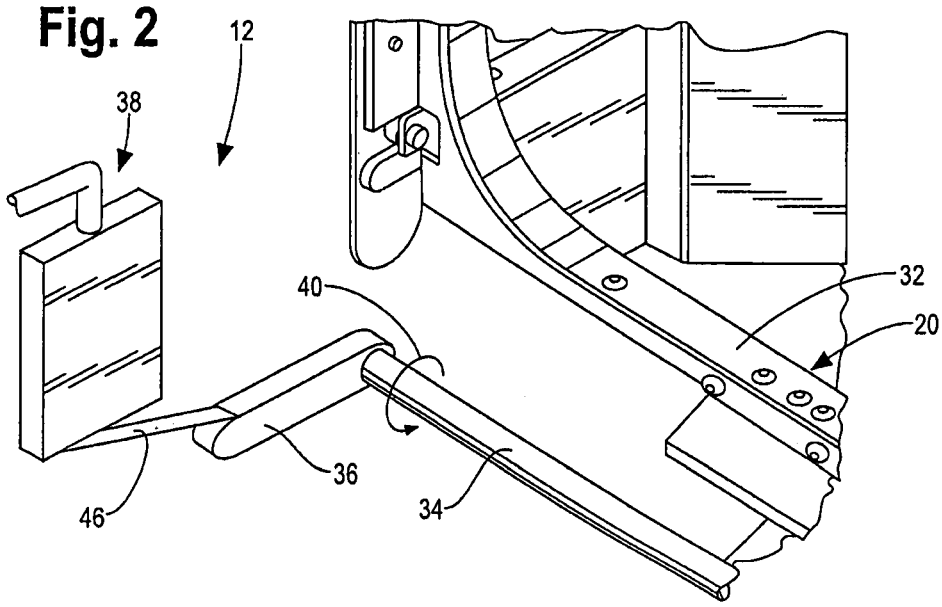
FIG. 2 is an enlarged, partial perspective illustration of the chute opening assembly showing the chute opening torsion bar and lever of the chute opening system.
Figure 3A:
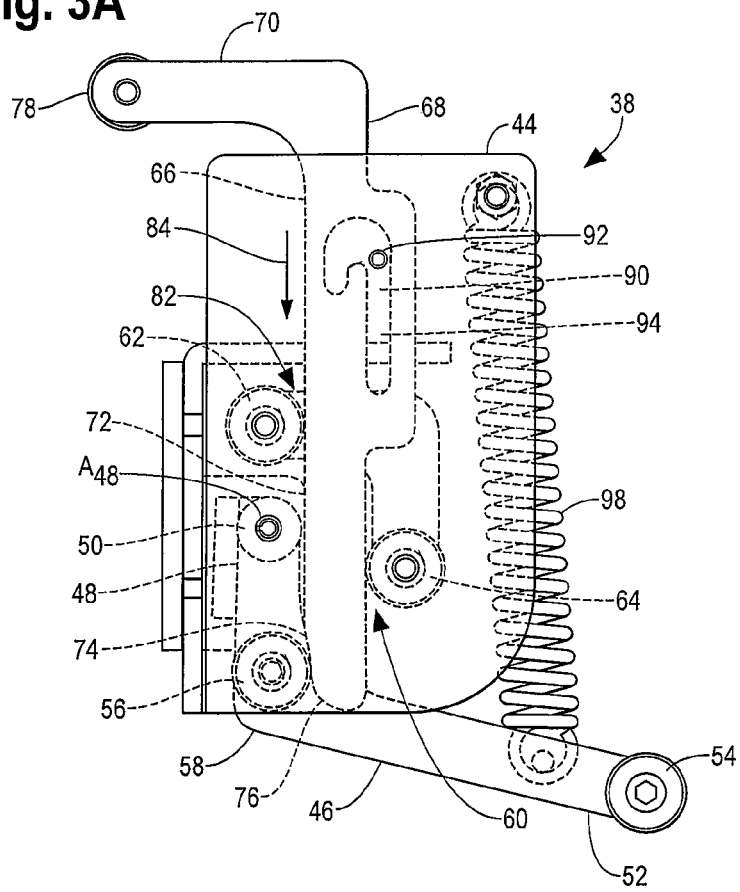
FIGS. 3A-3D are illustrations of the work surface actuator portion of the chute opening assembly showing the actuator portion (and in the case of FIG. 3B, the work surface) in the machine operating position.
Figure 3B:
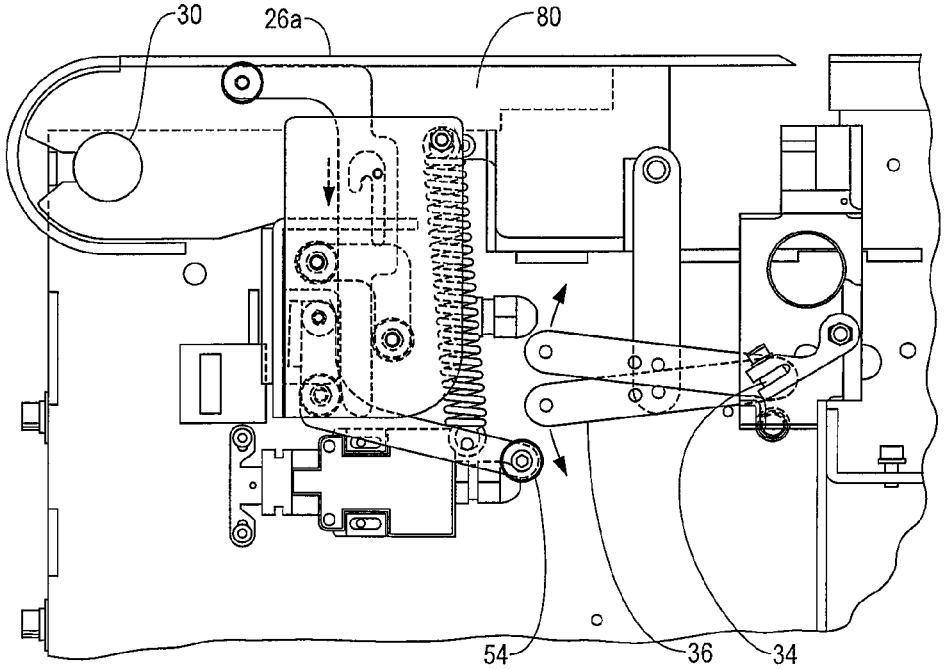
Figure 3C:
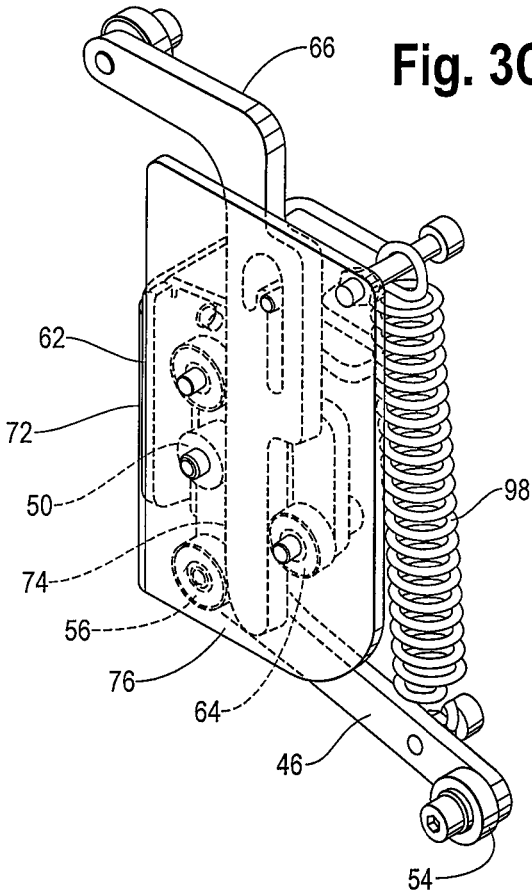
Figure 3D:
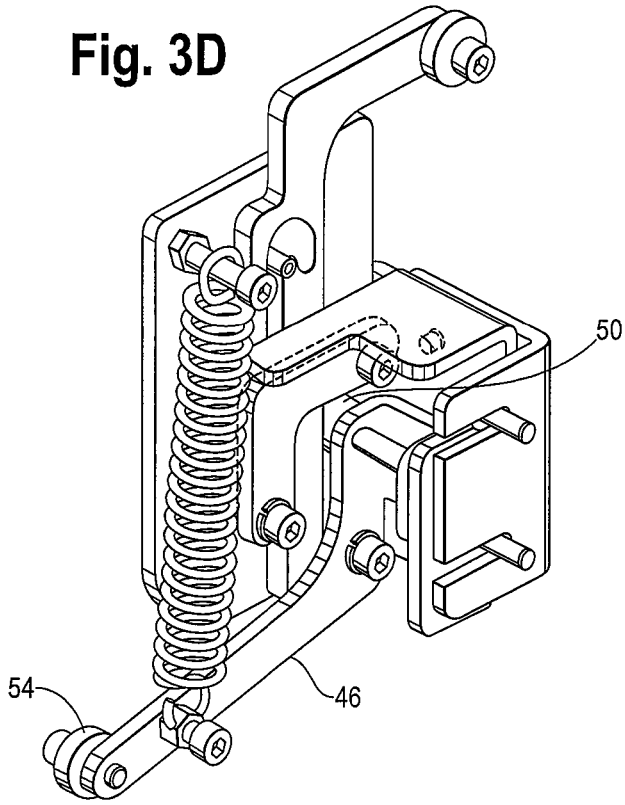

To provide easier access to the sealing head 14 and the internal areas of the chute 20, the chute 20 is configured to automatically open upon opening the top surface 26. To effect the automatic opening, the machine 10 includes the automatic chute opening system 12. The system 12 includes a torsion bar 34 and lever 36 (which are known elements) and an actuator 38 that cooperates with the torsion bar 34 and lever 36 to open and close the chute 20. Referring first to FIGS. 2 and 3B, the torsion bar 34 is operably connected to the chute 20 such that a turning or twisting motion (as indicated by the arrow at 40 in FIG. 2) on the bar 34 opens the chute 20. The chute 20 is biased to the closed position so that the "relaxed" state of the torsion bar 34 is with the chute 20 closed and a torque (as indicated at 40) is required to open the chute 20.

The lever 36 mounted to the torsion bar 34 operably connects the actuator 38 and the torsion bar 34. The actuator 38 is "actuated" by the top surface 26 and is mounted to the frame 22 just below the top surface 26. The actuator 38 includes a housing or chassis 44 having a lever contact arm 46 that is pivotally mounted to the body. In a present embodiment, the arm 46 is L-shaped and is mounted to the housing 44 at a pivot end 48. A roller 50 is mounted to the pivot end 48 (along the pivot axis $A_{48}$). A free end 52 of the arm 46 has a roller 54 mounted (the lever roller) thereto that engages the lever 36 to move the lever 36 downward to open the chute 20. A cam roller 56 is positioned on the arm 46, at about the heel 58 of the L.

A guide 60 is formed within the housing 44 a by a pair of spaced apart rollers 62, 64. The guide rollers 62, 64 are fixed so that they do not move or translate relative to their respective axes. One guide roller 62 is about aligned with the roller 50 at the pivot end 48 of the arm 46.

The system 12 includes a top surface contact or engaging element 66 having a body 68 having a top engaging portion 70, a straight side 72, and a slightly angled surface 74 that transitions into a cammed lower end 76. In a present embodiment, the top engaging portion 70 includes a roller 78 to permit free movement of the engaging element 66 along the bottom 80 of the top surface 26 (to reduce binding between the bottom 80 of the surface 26 and the engaging element 66).

Figure 4:
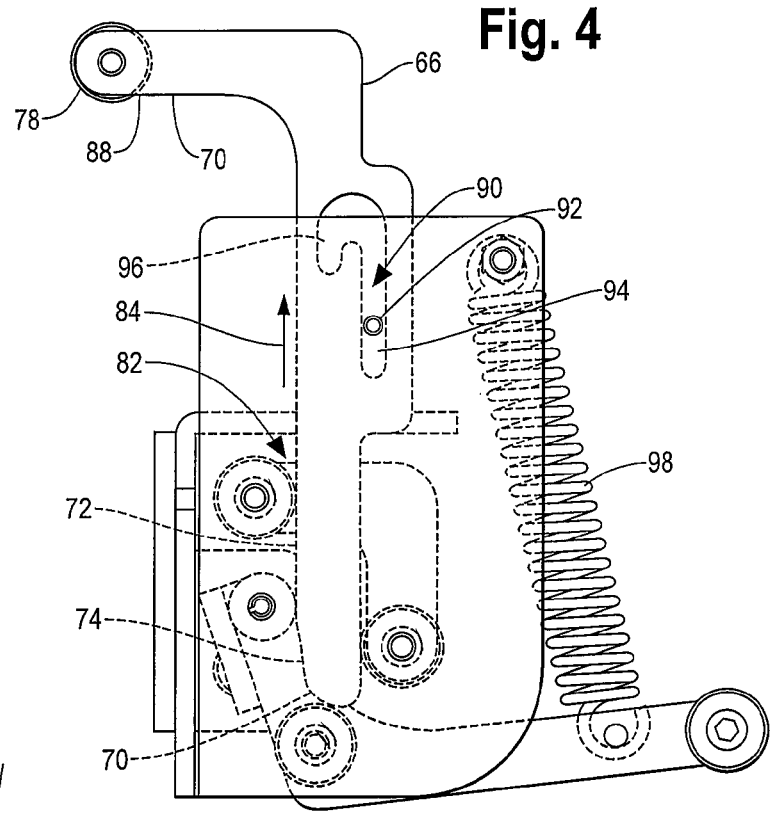
FIG. 4 is an illustration of the actuator portion with the work surface pivoted up or open.

The engaging element elongated body portion 68 resides in the guide 60 that is defined by the guide rollers 62, 64. The guide 60 maintains the engaging element 66 within a "track" (indicated generally at 82) so that it reciprocates (see, e.g., directional arrows 84 in FIGS. 3A and 4) with the removal (or pivoting) of the top surface 26. In a present embodiment, the engaging element 66 includes the top engaging portion 70 which extends generally transverse to the body 68, and the top engaging portion roller 78 is mounted to a free end 88 of the portion 70.

The body 68 includes a channel 90 that is configured to receive a pin 92 that is mounted to the housing 44. The channel 92 has an inverted J-shape (the J-channel), that is configured such that the pin 92 resides in the major (elongated) leg 94 of the J-channel 90 when the top 26 is in or moved between the open and closed positions. The shorter leg 96 of the J-channel 90 is a maintenance position, which will be described in more detail below.

As set forth above, the engaging element 66 includes a cammed lower end 76. The cammed end 76 (which is an end having a cam or curved surface), is configured to engage and move the cam roller 56 on the arm 46 to pivot the arm 46 downwardly. As the engaging element 66 is moved upwardly (as by pivoting the top 26 open), the engaging element cam surface 76 comes off of (or disengages from) the cam roller 56 and a spring 98 mounted to the arm 46 (between the lever roller 54 and the cam roller 56) biases the arm 46 upward to the chute open position. When in this position (e.g., the arm 46 biased upward), the cam roller 56 is in the track 82 of the rollers 62, 64. Accordingly, as the element 66 is urged down into the track 82, the cam surface 76 engages the cam roller 56 and the arm 46 is moved downward to close the strap chute 20. As such it is the action of the cam 76 acting on the cam roller 56 that moves the chute 20 closed, and is not solely a spring force that maintains the chute 20 closed.

It will be appreciated that in the known spring-biased only arrangements the extension spring that is used to urge the chute open is in the fully extended position when the top is pivoted down or closed. As such, when the top is down and the chute closed, the spring is fully extended. The result is that the weight of the top is used to maintain the chute closed. This is not so with the present arrangement in which the cam surface 76 engaging the roller 56 moves the lever 36 and torsion bar 34, and thus the chute 20 to the closed position, and the flat and slightly angled surfaces, 72, 74, respectively, of the element 66 engaging the roller 56 maintain the chute 20 closed. The spring 98 in the system 12 is thus used to urge the cam 76 along the cam roller 56 (to urge the engaging element 66 to the open position) and not to exert a force on the torsion bar 34 or lever 36.

Figure 5:
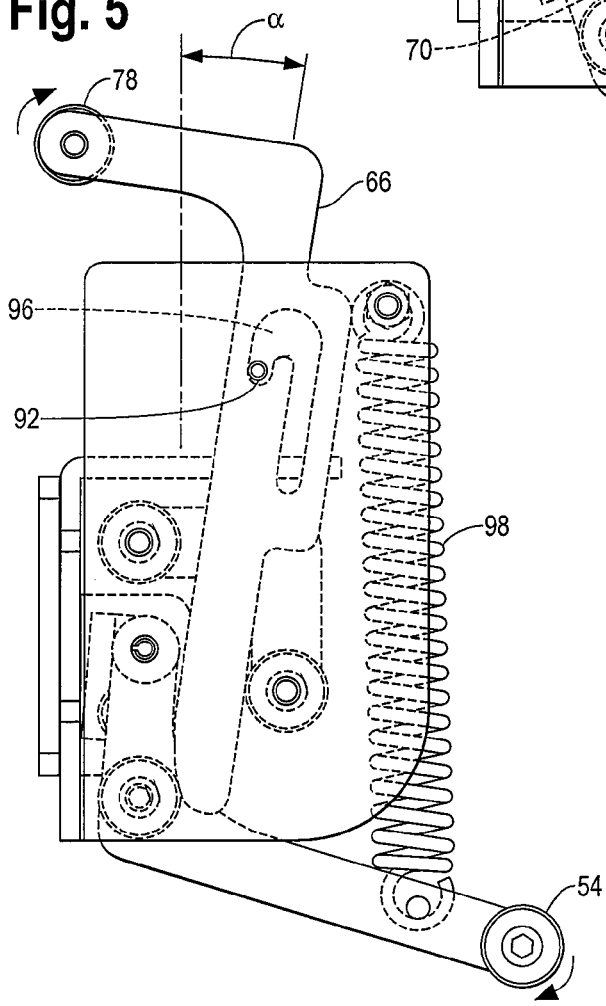
FIG. 5 is an illustration of the actuator portion in the maintenance position in which the work surface is pivoted up or open, but the chute remains closed.

The maintenance position, which is shown in FIG. 5 provides for the top 26 to be in the open position, but allows the chute 20 to move to the closed position, so that the chute 20 can function in a normal operating mode. This position may be used for certain maintenance, inspection and/or repair situations. When in the maintenance position, the sealing head 14 can be manually indexed through a cycle to further inspect and/or carry out maintenance on the machine 10. In the maintenance (or service) position, the element 66 is angled, as indicated at $\alpha$, relative to the track 82 (by virtue of the pin 92 being in the short leg 96 of the J-channel 90), which results in the arm 46 being pivoted down (to the closed chute position), but with the top engaging portion roller 78 pivoted upwardly to the top 26 open position.

Advantageously, when the top 26 is then closed (from the maintenance position), the top 26 contacts the roller 78 and automatically resets the actuator 38 by moving the engaging element 66 back within the track 82 (so that the pin 92 again resides within the long leg 94 of the channel 90. The force exerted by the spring 98 on the arm 46 (in conjunction with the top 26 contacting roller 78) is sufficient to pivot and reorient the engaging element 66.

Advantageously, the present automatic chute opening system 12 uses a cam 76 and roller 56 arrangement to automatically open the chute 20 when the top surface 26 is opened (pivoted upwardly). The bias or spring element 98 in the system 12 is used to return the actuator 38 (the engaging element 66) to the chute open position, rather than to open the chute 20 (as if by the spring force). Accordingly, it is not the weight of the top surface 26 that keeps the chute 20 closed (and the top surface 26 down); rather it is the cam roller 56 residing on a straighter section 72 or slightly angled surface 74 of the engaging element 66.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover all such modifications as fall within the scope of the claims.

What is claimed is:

1. A strap chute opening system for a strapping machine of the type for feeding a strapping material around a load, positioning, tensioning and sealing the strapping material around the load, the strapping machine having a frame, a work surface for supporting the load to be strapped, the work surface being movable relative to the frame between a closed position and an open position, a strap chute defining a strap path through which the strapping material is passed, a portion of the strap chute disposed below the surface, the strap chute being openable to release the strapping material therefrom during the strapping operation, and a strapping head disposed below the work surface, a portion of the strapping head interposed in the strap chute, the chute opening system comprising:

a torsional element operably connected to the strap chute to move the strap chute between an open position and a closed position;

an actuator operably connected to the torsional element, the actuator including a work surface engaging element engageable with the work surface and movable with the work surface between the open and closed positions, the work surface engaging element including a cam surface thereon, the actuator including a pivoting arm having a first end having a cam engaging element and a second end having a roller operably engageable with the torsional element, wherein when the work surface is in the closed position, the work surface engaging element is engaged with the work surface to urge the cam surface into engagement with the cam engaging element to pivot the pivoting arm to release the torsional element to urge the strap chute to the closed position, and wherein when the work surface is in the open position, the work surface is moved off of the work surface engaging element and the cam surface out of engagement with the cam engaging element to move the second end of the pivoting arm into operable engagement with the torsional element to apply a torque to the torsional element to open the strap chute.

2. The strap chute opening system in accordance with claim 1 including a biasing element to bias the pivoting arm into operable engagement with the torsional element to open the strap chute.

3. The strap chute opening system in accordance with claim 1 including a lever mounted to the torsional element, and wherein the pivoting arm is moved into and out of engagement with the lever to apply torque to and to release the torsional element.

4. The strap chute opening system in accordance with claim 1 wherein the actuator includes a guide defining a track for movement of the work surface engaging element.

5. The strap chute opening system in accordance with claim 4 wherein the guide restricts movement of the work surface engaging element in a reciprocating manner.

6. The strap chute opening system in accordance with claim 4 wherein the cam engaging element lies in the track and wherein engagement of the cam surface with the cam engaging element moves the cam engaging element out of the track.

7. The strap chute opening system in accordance with claim 4 wherein the pivoting arm includes a pivot axis and a roller at the pivot axis, at the pivot axis defining a portion of the track.

8. The strap chute opening system in accordance with claim 1 wherein the work surface engaging element includes an inverted J-shaped channel formed therein and wherein the actuator includes a pin extending therefrom engageable with the inverted J-shaped channel, the inverted J-shaped channel having an elongated leg and a short leg, and wherein the pin residing in the elongated leg corresponds to movement of the work surface engaging element moving with the work surface between the open and closed positions.

9. The strap chute opening system in accordance with claim 8 wherein the pin residing in the short leg corresponds to the work surface being in the open position and the cam surface urged into engagement with the cam engaging element to pivot the pivoting arm to release the torsional element to urge the strap chute to the closed position.

10. The strap chute opening system in accordance with claim 4 wherein the guide is defined by a plurality of rollers.

11. The strap chute opening system in accordance with claim 1 wherein the work surface engaging element includes a friction reducing element for engaging the work surface.

12. A strap chute opening system for a strapping machine of the type for feeding a strapping material around a load, positioning, tensioning and sealing the strapping material around the load, the strapping machine having a frame, a work surface for supporting the load to be strapped, the work surface being movable relative to the frame between a closed position and an open position, a strap chute defining a strap path through which the strapping material is passed, a portion of the strap chute disposed below the surface, the strap chute being openable to release the strapping material therefrom during the strapping operation, and a strapping head disposed below the work surface, a portion of the strapping head interposed in the strap chute, the chute opening system comprising:

a torsional element operably connected to the strap chute to move the strap chute between an open position and a closed position;

an actuator operably connected to the torsional element, the actuator including a pivoting arm having a first cam roller on a first end and a second roller on a second end, the actuator further including a work surface engaging element movable with the work surface between the closed and open positions, the work surface engaging element movable into and out of contact with the first cam roller of the pivoting arm when the work surface is in the closed and open positions, respectively, the second roller of the pivoting arm being operably engageable with the torsional element to close and open the strap chute, respectively.

13. The strap chute opening system in accordance with claim 12 wherein the pivoting arm is biased to engage the torsional element and wherein movement of the engaging element out of contact with the pivoting arm moves the pivoting arm to engage the torsional element.

14. The strap chute opening system in accordance with claim 12 wherein the work surface engaging element includes a curved cam surface and a straight surface and wherein the straight surface contacts the pivoting arm when the work surface is closed.

15. The strap chute opening system in accordance with claim 14 wherein the first cam roller disposed on the pivoting arm, spaced from a pivot axis, for engagement with the cam surface.

16. A strapping machine of the type for feeding a strapping material around a load, positioning, tensioning and sealing the strapping material around the load, comprising:

a frame;

a work surface for supporting the load to be strapped, the work surface having a portion that is movable between a closed position and an open position;

a strap chute defining a path through which the strapping material is fed, a portion of the strap chute being below the work surface, the strap chute being openable to release the strapping material therefrom during the strapping operation;

a strapping head for receiving the strapping material, sealing the strapping material to itself in overlaying courses and severing the strapping material from a supply; and a strap chute opening system including a torsional element operably connected to the strap chute to move the strap chute between an open position and a closed position and an actuator operably connected to the torsional element, the actuator including a work surface engaging element engageable with the work surface and movable with the work surface between the open and closed positions, the work surface engaging element including a cam surface thereon, the actuator including a pivoting arm having a first end having a cam engaging element and a second end having a roller operably engageable with the torsional element, wherein when the work surface is in the closed position, the work surface engaging element is engaged with the work surface to urge the cam surface into engagement with the cam engaging element to pivot the pivoting arm to release the torsional element to urge the strap chute to the closed position, and wherein when the work surface is in the open position, the work surface is moved off of the work surface engaging element and the cam surface out of engagement with the cam engaging element to move the second end of the pivoting arm into operable engagement with the torsional element to apply a torque to the torsional element to open the strap chute.

17. The strapping machine in accordance with claim 16 including a biasing element to bias the pivoting arm into operable engagement with the torsional element to open the strap chute.

18. The strapping machine in accordance with claim 16 wherein the actuator includes a guide defining a track for movement of the work surface engaging element and wherein the arm includes a roller at the pivot that defines a portion of the track.

19. The strap chute opening system in accordance with claim 18 wherein the cam engaging element lies in the track and wherein engagement of the cam surface with the cam engaging element moves the cam engaging element out of the track.

20. The strap chute opening system in accordance with claim 16 wherein the work surface engaging element includes an inverted J-shaped channel formed therein and wherein the actuator includes a pin extending therefrom engageable with the inverted J-shaped channel, the inverted J-shaped channel having an elongated leg and a short leg, and wherein the pin residing in the elongated leg corresponds to movement of the work surface engaging element moving with the work surface between the open and closed positions, and wherein the pin residing in the short leg corresponds to the work surface being in the open position and the cam surface urged into engagement with the cam engaging element to pivot the arm to release the torsional element to urge the strap chute to the closed position.

* * * * *

UNITED STATES PATENT AND TRADEMARK OFFICE

CERTIFICATE OF CORRECTION

PATENT NO. : 7,263,928 B1
APPLICATION NO. : 11/554480
DATED : September 4, 2007
INVENTOR(S) : Holden et al.

It is certified that error appears in the above-identified patent and that said Letters Patent is hereby corrected as shown below:

Col. 6, Claim 7, Line 3 should read:

-- a roller at the pivot axis, the roller at the pivot axis defining a portion--

Col. 7, Claim 15, Line 2 should read:

-- claim 14 wherein the first cam roller is disposed on the--

Signed and Sealed this

Sixth Day of November, 2007

JON W. DUDAS
*Director of the United States Patent and Trademark Office*